US007460819B2

(12) United States Patent
Kaiho

(10) Patent No.: US 7,460,819 B2
(45) Date of Patent: Dec. 2, 2008

(54) TONER CARTRIDGE AND IMAGE FORMING APPARATUS

(75) Inventor: Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 287 days.

(21) Appl. No.: 11/312,598

(22) Filed: Dec. 21, 2005

(65) Prior Publication Data

US 2007/0140746 A1 Jun. 21, 2007

(51) Int. Cl.
*G03G 15/08* (2006.01)

(52) U.S. Cl. ..... 399/262

(58) Field of Classification Search ..... 399/107, 399/120, 252, 258, 262; 222/DIG. 1
See application file for complete search history.

(56) References Cited

U.S. PATENT DOCUMENTS 5,441,177 A * 8/1995 Yanagisawa ..... 222/167
5,515,143 A * 5/1996 Shiotani ..... 399/106
5,722,014 A * 2/1998 Fike ..... 399/119
5,828,935 A * 10/1998 Tatsumi et al. ..... 399/260
5,991,584 A * 11/1999 Meyer et al. ..... 399/262

FOREIGN PATENT DOCUMENTS

JP 06-266227 A 9/1994
JP 2001-083792 A 3/2001

* cited by examiner

*Primary Examiner*—Hoan H Tran
(74) *Attorney, Agent, or Firm*—Foley & Lardner LLP

(57) ABSTRACT

A toner cartridge includes a toner container which contains toner, the toner container having at one end portion thereof a discharge port which discharges the toner, and a member which is attached to an outer peripheral surface of the one end portion. The member has a first part which is engaged with the one end portion, and a second part which has, at a position corresponding to the discharge port, a passage hole through which the toner discharged from the discharge port passes.

6 Claims, 7 Drawing Sheets

TONER CARTRIDGE AND IMAGE FORMING APPARATUS

BACKGROUND OF THE INVENTION

1. Field of the Invention

The present invention relates to a toner cartridge for use in an image forming apparatus such as a copying machine, a facsimile or a printer, and to an image forming apparatus in which the toner cartridge is mounted.

2. Description of the Related Art

In an image forming apparatus such as a copying machine, a facsimile or a printer, a toner cartridge functions to supply toner to a developing device and is detachably mounted in the image forming apparatus. The toner cartridge is detachably mounted in order to enable a user himself/herself to perform a replacing operation when toner in the toner cartridge runs short.

If a toner cartridge is mounted in the image forming apparatus, a cartridge holder which is disposed in the image forming apparatus is rotated. Thereby, the toner cartridge that is held by the cartridge holder rotates along with the cartridge holder and supplies a necessary amount of toner to the developing device.

A conventional toner cartridge comprises a toner container which contains toner, a shutter which opens/closes a discharge port that is formed in the toner container, and a cap which closes a filling port that is formed in the toner container. In other words, the conventional toner cartridge is composed of three pieces that are manufactured separately.

Of these components, the shutter is provided to be slidable relative to the discharge port of the toner container. By a mounting operation of the toner cartridge, the shutter opens the discharge port. By a removing operation of the toner cartridge, the shutter closes the discharge port. This prevents leak of toner when the toner cartridge is not mounted in the image forming apparatus.

However, even when the toner cartridge is mounted in the image forming apparatus, toner may, in some cases, leak from a gap between the toner cartridge and the cartridge holder. To prevent this, a seal member is provided to prevent toner, which is discharged from the toner cartridge, from flowing into the gap. The seal member is attached to the toner cartridge or cartridge holder, and the seal member is formed in an annular shape so as to surround the discharge port of the toner cartridge.

In usual cases, the toner container is formed of, e.g. polyethylene (PE) by blow molding. The blow molding is suited to manufacturing of hollow articles, and the cost of blow molding is low. Thus, the blow molding is a manufacturing method suitable for toner containers which are consumable components. However, the processing precision of the blow molding is low, and non-uniformity may, in some cases, occur in the dimensional precision of finished toner containers.

If the dimensional precision of the toner container is low, the insertion/positioning of the toner cartridge cannot precisely be performed. In some cases, such a problem will arise that the toner cartridge may contact a part of the image forming apparatus while it is being inserted or removed, and the seal member may be removed or the shutter is moved, resulting in leak of toner.

BRIEF SUMMARY OF THE INVENTION

The object of the present invention is to provide a toner cartridge having a high dimensional precision of a part thereof that engages an image forming apparatus, while the manufacturing cost of the toner cartridge is low, and to provide an image forming apparatus in which the toner cartridge is mounted.

In order to solve the above-described problem and to achieve the object of the invention, the toner cartridge and the image forming apparatus according to the present invention have the following structures:

(1) A toner cartridge comprising:

a toner container which contains toner, the toner container having at one end portion thereof a discharge port which discharges the toner; and a member which is attached to an outer peripheral surface of the one end portion, the member having:

a first part which is engaged with the one end portion; and a second part which has, at a position corresponding to the discharge port, a passage hole through which the toner discharged from the discharge port passes.

(2) The toner cartridge according to (1), wherein the member has a projection portion which is formed on an outer surface of the member and extends in an axial direction of the toner container.

(3) The toner cartridge according to (1), wherein the member has a groove portion which is formed on an outer surface of the member and extends in an axial direction of the toner container.

(4) The toner cartridge according to (1), wherein the member has a plurality of projection portions which are formed on an outer surface of the member and extend in a circumferential direction of the toner container, at least one of the projection portions being disposed on both sides of the discharge port and the passage hole in an axial direction of the toner container.

(5) The toner cartridge according to (1), further comprising a shutter which is slidably provided on the second part and opens and closes the discharge port.

(6) The toner cartridge according to (5), further comprising a seal member which is disposed in a gap between the second part and the shutter.

(7) The toner cartridge according to (1), wherein the toner container includes:

a toner filling port which is formed at the other end portion of the toner container and through which toner is filled in the toner container.

(8) A toner cartridge comprising:

toner container means for containing toner, the toner container means having at one end portion thereof a discharge port which discharges the toner; and a member which is attached to an outer peripheral surface of the one end portion, the member having:

a first part which is engaged with the one end portion; and a second part which has, at a position corresponding to the discharge port, a passage hole through which the toner discharged from the discharge port passes.

(9) An image forming apparatus comprising:

an apparatus main body in which a space is defined;

an image carrying unit which is disposed within the apparatus main body;

an image forming unit which is disposed within the apparatus main body and forms an electrostatic latent image on the image carrying unit;

a developing unit which is disposed within the apparatus main body and supplies toner to the electrostatic latent image, thereby forming a toner image, which corresponds to the electrostatic latent image, on the image carrying unit;

a transfer unit which is disposed within the apparatus main body and transfers the toner image, which is formed on the image carrying unit, to a transfer medium; and a toner cartridge which is detachably mounted in the apparatus main body and supplies toner to the developing unit, the toner cartridge including:

a toner container which contains toner, the toner container having at one end portion thereof a discharge port which discharges the toner that is contained in the toner container; and a member which is attached to the one end portion of the toner container, the member having:

a first part which is engaged with the one end portion and is engaged, when the toner cartridge is mounted in the apparatus main body, with a part of the apparatus main body, thereby determining a position and an attitude of the member; and a second part which has, at a position corresponding to the discharge port, a passage hole through which the toner discharged from the discharge port passes.

(10) The image forming apparatus according to (9), wherein the member has a projection portion which is formed on an outer surface of the member and extends in an axial direction of the toner container, the projection portion being guided by a part of the apparatus main body at a time of mounting in the apparatus main body.

(11) The image forming apparatus according to (9), wherein the member has a groove portion which is formed on an outer surface of the member and extends in an axial direction of the toner container, the groove portion being guided by a part of the apparatus main body at a time of mounting in the apparatus main body.

(12) The image forming apparatus according to (9), wherein the member has a plurality of projection portions which are formed on an outer surface of the member and extend in a circumferential direction of the toner container, at least one of the projection portions being disposed on both sides of the discharge port and the passage hole in an axial direction of the toner container.

(13) The image forming apparatus according to (9), further comprising a shutter which is slidably provided on the second part and opens and closes the discharge port.

(14) The image forming apparatus according to (13), further comprising a seal member which is disposed in a gap between the second part and the shutter.

(15) The image forming apparatus according to (9), wherein the toner container includes:

a toner filling port which is formed at the other end portion of the toner container and through which toner is filled in the toner container.

According to the present invention, the mounting of the toner cartridge in the image forming apparatus can smoothly and properly be performed. Moreover, the manufacturing cost of the toner cartridge will not greatly increase.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described in detail with reference to the accompanying drawings.

(Structure of Electrophotographic Copying Machine)

Figure 1:
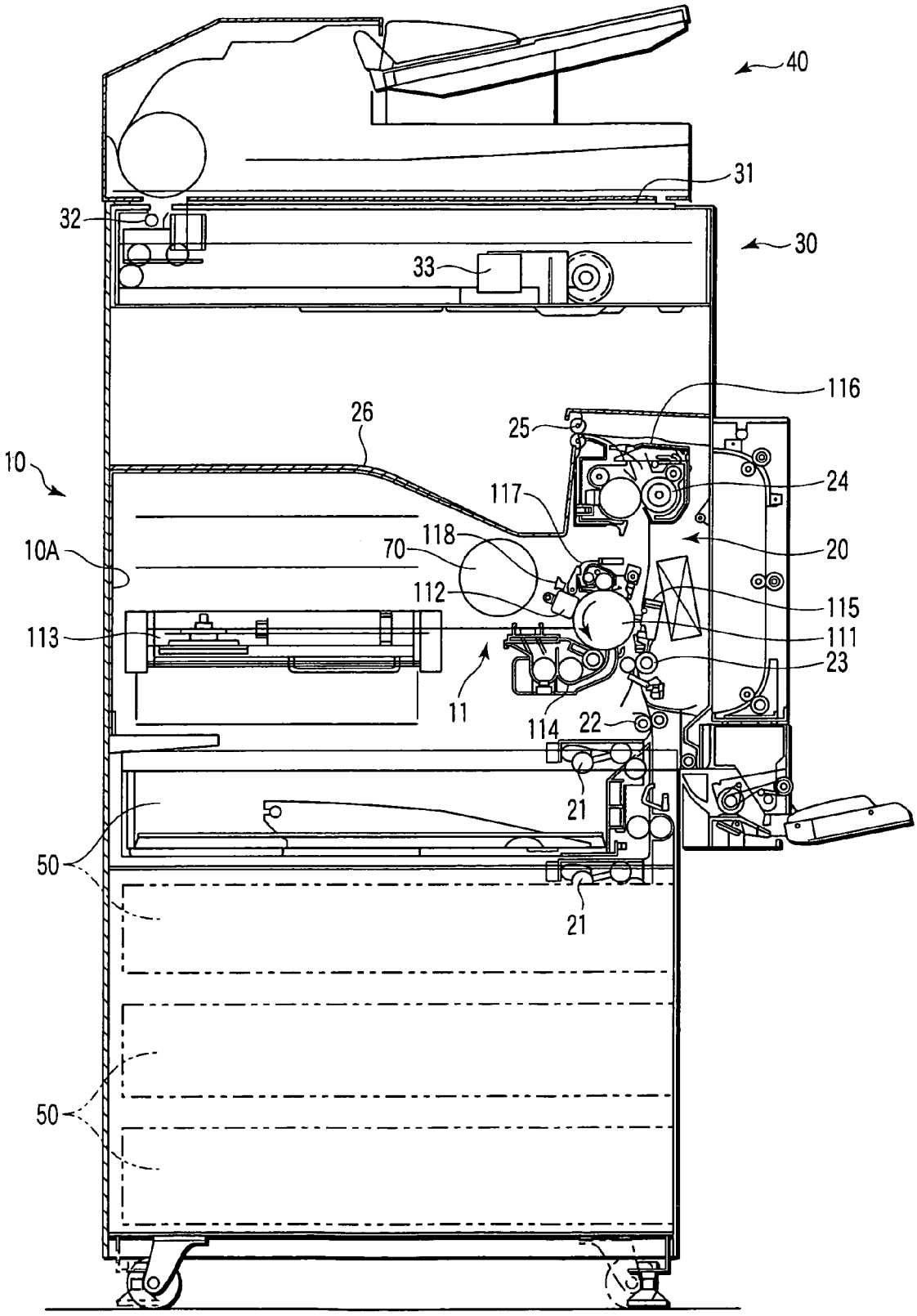
FIG. 1 is a schematic view of an electrophotographic copying machine according to an embodiment of the present invention.

FIG. 1 is a schematic view of an electrophotographic copying machine according to an embodiment of the present invention.

As is shown in FIG. 1, the electrophotographic copying machine according to the embodiment comprises a copying machine main body 10, a convey system 20, a scanner unit 30, an automatic document feeder 40, a sheet feed cassette 50, a driving device 60 (see FIGS. 2 and 3) and a toner cartridge 70.

[Copying Machine Main Body 10]

The copying machine main body 10 has an accommodation space 10A. An image forming unit 11 is provided in the accommodation space 10A. The image forming unit 11 includes a photoconductor drum (image carrying unit) 111 that is rotated in the direction of an arrow. Around the photoconductor drum 111, the following components are provided successively in the direction of rotation of the photoconductor drum 111: a charger 112 that charges the surface of the photoconductor drum 111; a laser unit (image forming unit) 113 that forms an electrostatic latent image on the surface of the photoconductor drum 111; a developing device (developing unit) 114 that develops the electrostatic latent image, which is formed on the surface of the photoconductor drum 111, with toner; a transfer device (transfer unit) 115 that transfers a toner image (visible image), which is developed on the surface of the photoconductor drum 111, to a paper sheet (transfer medium); a fixing device 116 that fixes the toner image, which is transferred to the paper sheet, on the paper sheet; a cleaning device 117 that removes toner remaining on the surface of the photoconductor drum 111; and a charge erase lamp 118 that erases the charge remaining on the surface of the photoconductor drum 111.

[Convey System 20]

The convey system 20 is provided within the casing of the copying machine main body 10. The convey system 20 comprises a pickup roller 21, a convey roller 22, a registration roller 23, a fixing roller 24 and an output roller 25. An output tray 26 is disposed on a side of the output roller 25. A paper sheet, which is conveyed by the convey system 20, is finally discharged to the output tray 26.

[Scanner Unit 30]

The scanner unit 30 is provided on the upper side of the casing of the copying machine main body 10. The scanner unit 30 comprises a transparent original table 31 that is fitted in an opening made in the upper wall of the casing of the copying machine main body 10; a light source 32 that illuminates an original on the original table 31 through the original table 31; and a light receiving element 33 that receives reflective light from the original.

[Automatic Document Feeder 40]

The automatic document feeder 40 is disposed on the upper side of the scanner unit 30. One end portion of the automatic document feeder 40 is rotatably coupled to the casing of the copying machine main body 10. Thus, if the other end portion of the automatic document feeder 40 is lifted up, the original table 31 is exposed from between the automatic document feeder 40 and the scanner unit 30.

[Sheet Feed Cassette 50]

The sheet feed cassette 50 is disposed in a lower part within the casing of the copying machine main body 10. The sheet feed cassette 50 contains a plurality of paper sheets. The sheets in the sheet feed cassette 50 are picked up, where necessary, by the pickup roller 21 of the convey system 20 and are fed into the image forming unit 11 of the copying machine main body 10.

[Driving Device 60]

The driving device 60 is disposed in a rear part within the casing of the copying machine main body 10. The driving device 60 rotates, where necessary, the toner cartridge 70 that is mounted in the copying machine main body 10.

Figure 2:
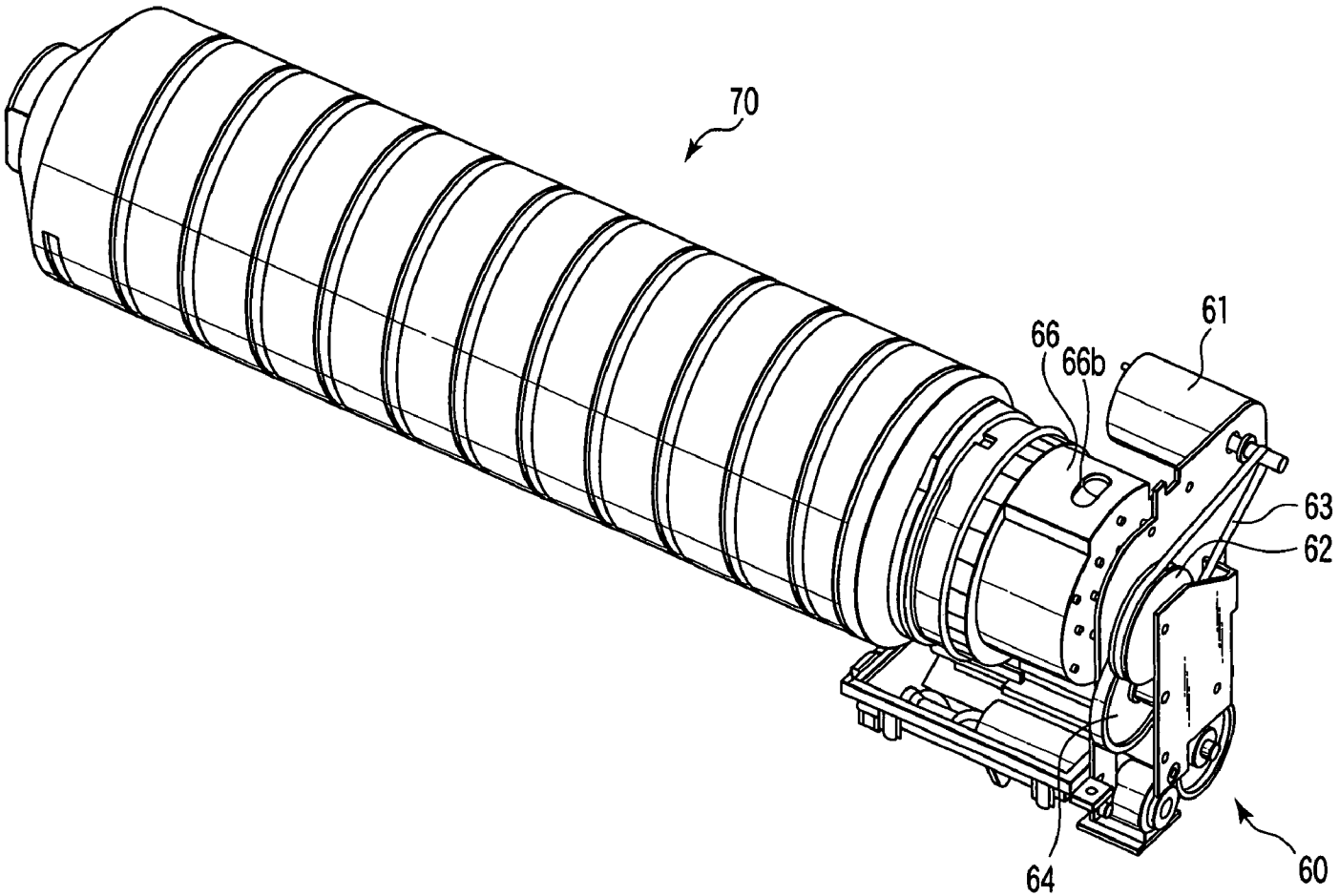
FIG. 2 is a perspective view of a driving device and a toner cartridge in the embodiment.
Figure 3:
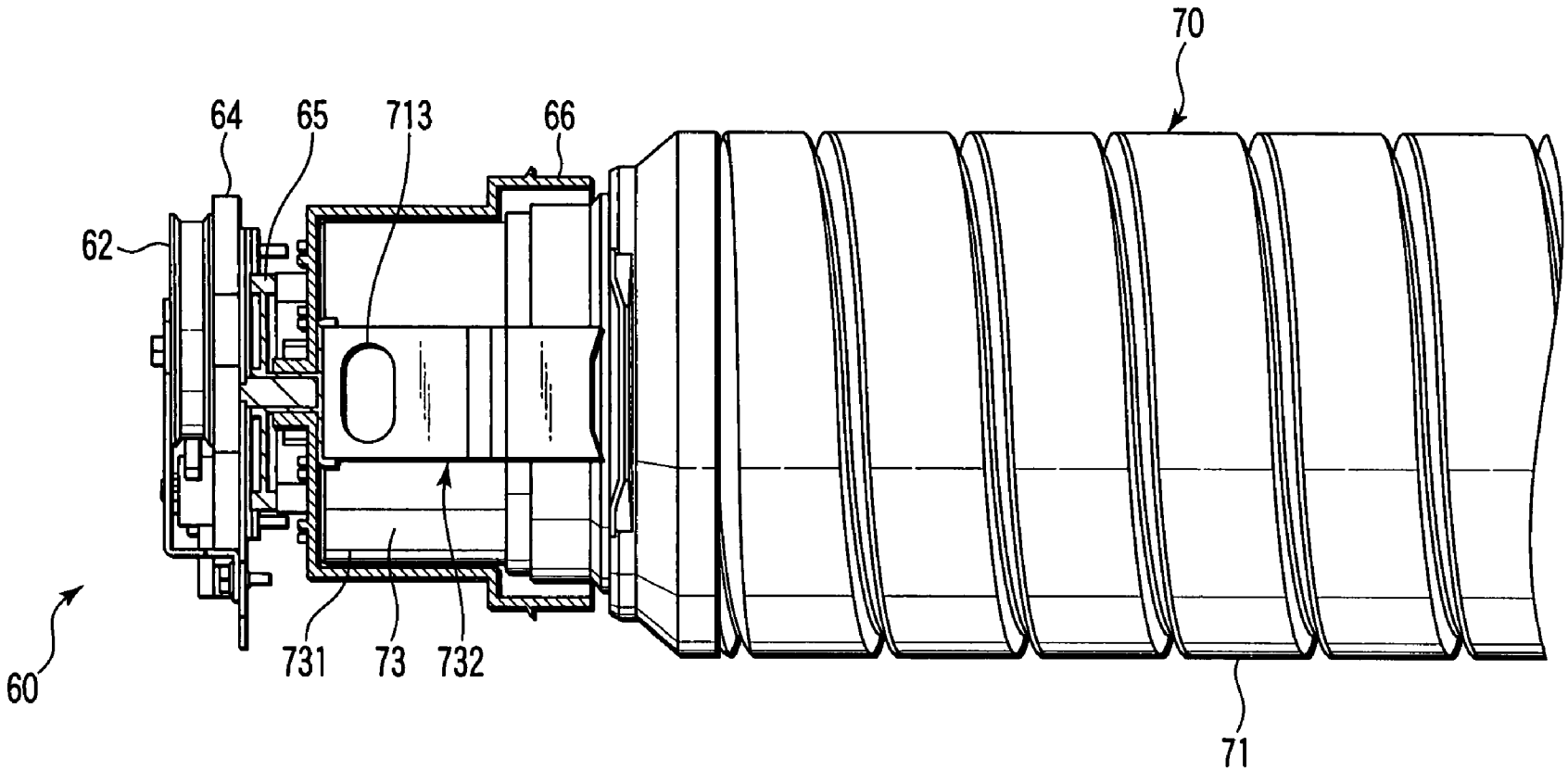
FIG. 3 is a side view of the driving device and toner cartridge in the embodiment.

FIG. 2 is a perspective view of the driving device 60 and toner cartridge 70 in the embodiment, and FIG. 3 is a side view of the driving device 60 and toner cartridge 70 in the embodiment.

As shown in FIG. 2 and FIG. 3, the driving device 60 comprises a motor 61, a pulley 62, a belt 63, a first driving gear 64, a second driving gear 65 and a cartridge holder 66. The belt 63 is passed between the motor 61 and pulley 62, and transmits a torque from the motor 61 to the pulley 62. The pulley 62 is meshed with the first driving gear 64, and transmits the torque from the motor 61 to the first driving gear 64. The first driving gear 64 is meshed with the second driving gear 65, and transmits the torque from the pulley 62 to the second driving gear 65. The second driving gear 65 is coupled to the cartridge holder 66, and transmits the toque from the first driving gear 64 to the cartridge holder 66.

Figure 4:
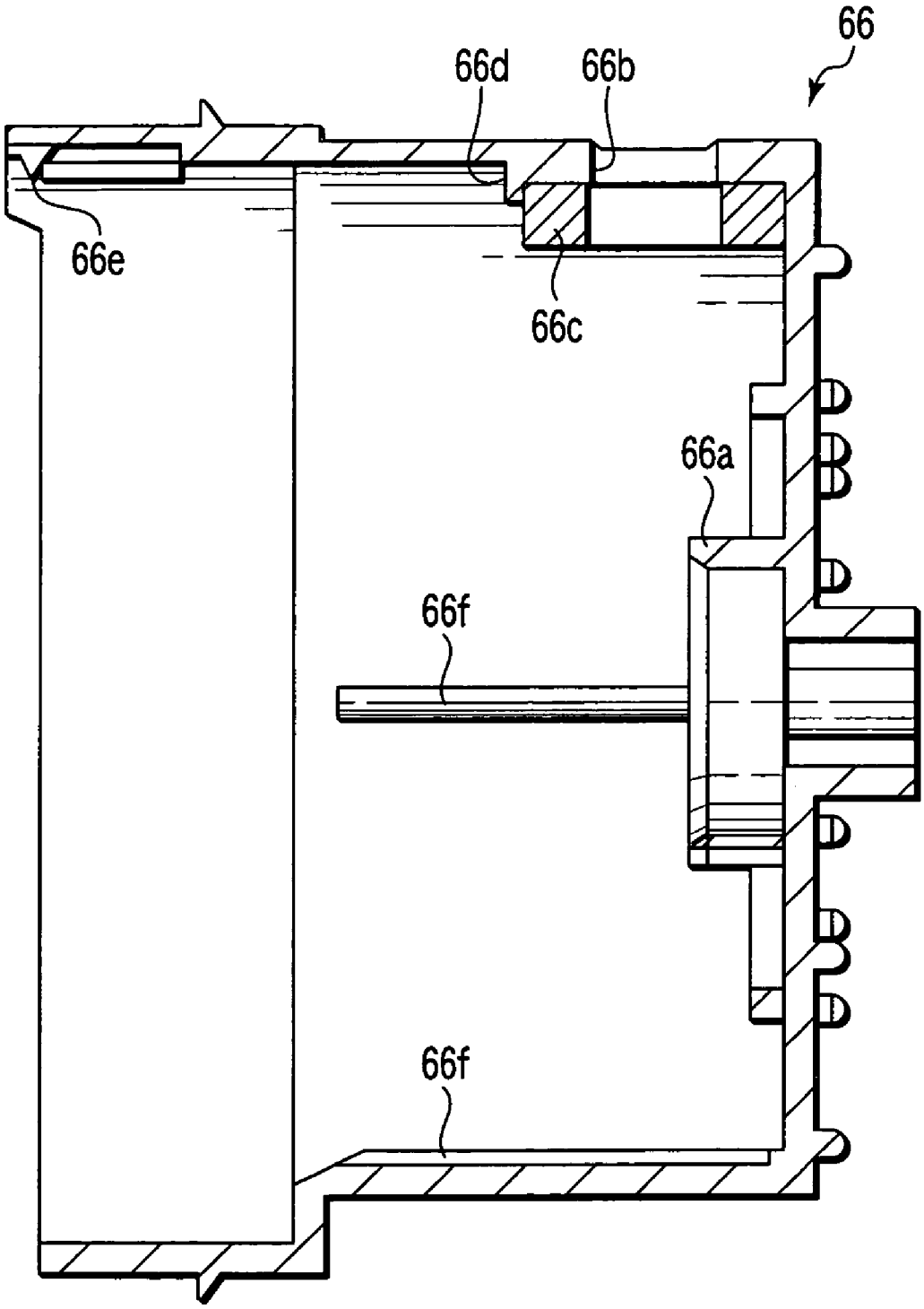
FIG. 4 is a cross-sectional view of a cartridge holder according to the embodiment.

FIG. 4 is a cross-sectional view of the cartridge holder 66 according to the embodiment.

As is shown in FIG. 4, the cartridge holder 66 is formed in a substantially cylindrical shape. The cartridge holder 66 has a bottom wall at one end in its axial direction. Injection molding having high processing precision is used as a manufacturing method of the cartridge holder 66. Thus, the dimensional precision of each part of the cartridge holder 66 is very high.

The inner surface of the bottom wall of the cartridge holder 66 is provided with a recess-and-projection portion 66*a*. The shape and size of the recess-and-projection portion 66*a* are determined in accordance with the version, point of destination, etc. of the electrophotographic copying machine.

A communication port 66*b* is formed in a peripheral wall of the cartridge holder 66. Toner, which is discharged from the toner cartridge 70, is supplied to the developing device 114 via the communication port 66*b*.

A seal member 66*c* is provided on an inner surface of the peripheral wall of the cartridge holder 66 at a position corresponding to the communication port 66*b*. The seal member 66*c* surrounds the peripheral edge of the communication port 66*b*, and prevents toner, which is discharged from the toner cartridge 70, from flowing out through a gap between the cartridge holder 66 and toner cartridge 70.

A first engaging portion 66*d* is provided on the inner surface of the peripheral wall of the cartridge holder 66 at a position away from the communication port 66*b* as a reference position by a predetermined distance in the axial direction of the cartridge holder 66. When the toner cartridge 70 is inserted in the cartridge holder 66, the first engaging portion 66*d* abuts upon a closing plate 741 that is provided on a shutter 74 of the toner cartridge 70.

A second engaging portion 66*e* is provided on the inner surface of the peripheral wall of the cartridge holder 66 at a position away from the first engaging portion 66*d* as a reference position by a predetermined distance in the axial direction of the cartridge holder 66. When the toner cartridge 70 is removed from the cartridge holder 66, the second engaging portion 66*e* abuts upon engaging rods 742 of the shutter 74 of the toner cartridge 70.

Groove portions 66*f* for guiding are formed in the inner surface of the peripheral wall of the cartridge holder 66. The groove portions 66*f* extend in the axial direction of the cartridge holder 66. As mentioned above, injection molding with high processing precision is used as a manufacturing method of the cartridge holder 66. Accordingly, the dimensional precision of the guide groove portions 66*f* is also very high. When the toner cartridge 70 is inserted in the cartridge holder 66, the guide groove portions 66*f* receive projection portions 731*b* for guiding of the toner cartridge 70, and determine the direction of insertion of the toner cartridge 70.

[Toner Cartridge 70]

The toner cartridge 70 is detachably mounted above the developing device 114 within the casing of the copying apparatus main body 10. The toner cartridge 70, where necessary, supplies toner to the developing device 114.

Figure 5:
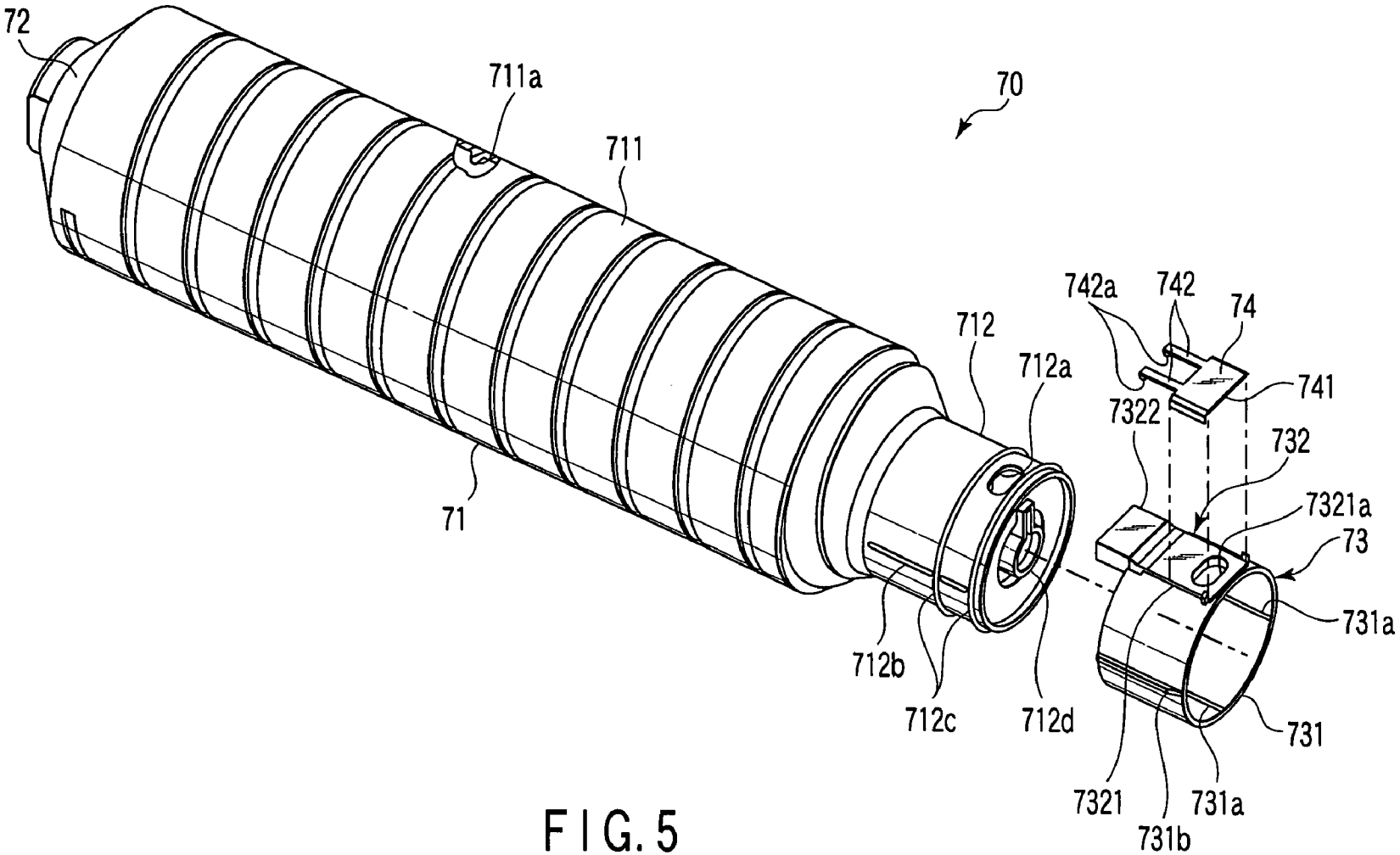
FIG. 5 is a first exploded perspective view of the toner cartridge in the embodiment.
Figure 6:
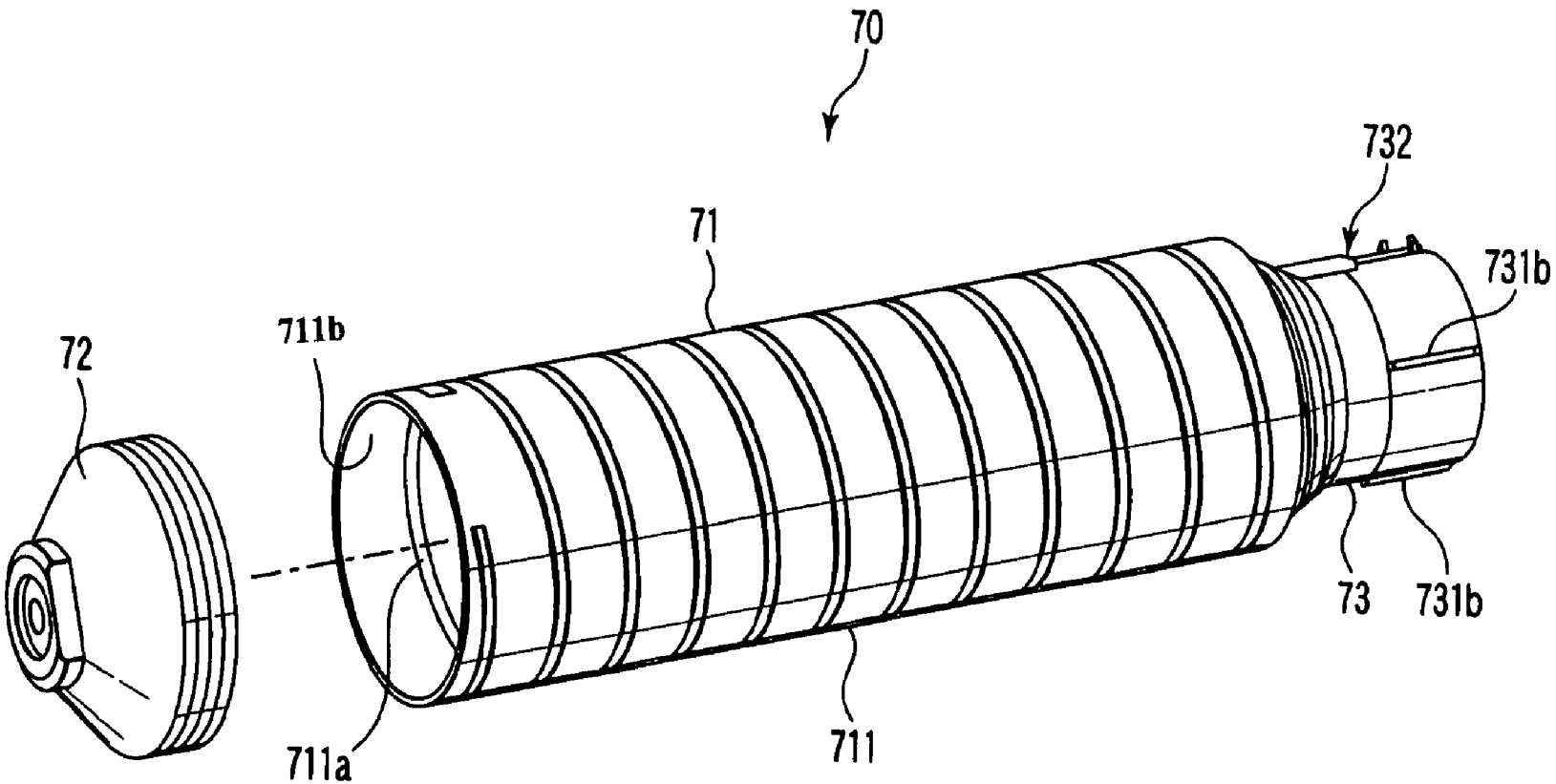
FIG. 6 is a second exploded perspective view of the toner cartridge in the embodiment.

FIG. 5 is a first exploded perspective view of the toner cartridge in the embodiment, and FIG. 6 is a second exploded perspective view of the toner cartridge in the embodiment.

As is shown in FIG. 5 and FIG. 6, the toner cartridge 70 includes a toner container 71, a cap 72, an insertion guide 73 and the shutter 74.

The toner container 71 is formed in a substantially cylindrical shape. The toner container 71 mainly comprises a first container section 711 and a second container section 712. The first container section 711 and second container section 712 are coupled to each other, and toner is contained therein. The method of forming the toner container 71 is not limited. For example, blow molding, the cost of which is low, may be used. The material of the toner container 71 is not limited. Polyethylene (PE), for instance, may be used.

The first container section 711 has a greater outside diameter than the second container section 712. A helical projection portion 711*a* is formed on the inner surface of the peripheral wall of the first container section 711. Thereby, when the toner cartridge 70 is rotated, the toner contained in the first container section 711 is conveyed toward a discharge port 712*a* by the motion of the projection portion 711*a*.

A filling port 711*b* for filling toner is formed at an end portion of the first container section 711. The filling port 711*b* is opening over the entirety of the end portion of the first container section 711, thereby to enhance the efficiency of filling of toner.

The second container section 712 has a smaller outside diameter than the first container section 711. The discharge port 712*a* for discharging toner, which is contained in the first and second container sections 711 and 712, is formed in the peripheral wall of the second container section 712.

Projection portions 712*b* for positioning and projection portions 712*c* for sealing are formed on the outer surface of the peripheral wall of the second container section 712.

The projection portions 712*b* for positioning extend in the axial direction of the toner container 71. When the insertion guide 73 is engaged with the second container section 712, the projection portions 712*b* for positioning are received in groove portions 731*a* for positioning, which are formed in the inner surface of the insertion guide 73. Thereby, the relative position and attitude of the second container section 712 and insertion guide 73 are exactly and uniquely determined.

The projection portions 712*c* for sealing extend in the circumferential direction of the toner container 71. The projection portions 712*c* for sealing are arranged in the axial direction of the toner container 71 so as to sandwich the discharge port 712*a*. The distance between the axis of the second container section 712 and the end face of each projection 712*c* is set to be greater than the inside radius of the insertion guide 73.

Thus, if the second container section 712 is inserted in the insertion guide 73, the projection portions 712*c* for sealing are put in close contact with the inner surface of the insertion guide 73 under high pressure. Thereby, a gap between the second container section 712 and insertion guide 73 is sealed, and toner is prevented from flowing out from between the second container section 712 and insertion guide 73.

A recess-and-projection portion 712*d* for identification of the toner cartridge 70 is formed on the outer end surface of the second container section 712. The shape and dimensions of the recess-and-projection portion 712*d* are determined in accordance with the version, point of destination, etc. of the toner cartridge 70. Thereby, only when the model type of the electrophotographic copying machine agrees with the type of the toner cartridge 70, can the recess-and-projection portion 712*d*, which is formed on the second container section 712, correctly be engaged with the recess-and-projection portion 66*a*, which is formed on the cartridge holder 66 of the driving device 60. Thus, the toner cartridge 70 can completely be mounted.

The cap 72 is fitted on the filling port 711*b* formed in the end portion of the first container section 711. The cap 72 prevents outflow of toner that is contained in the first and second container sections 711 and 712. The cap 72 is fitted after toner is filled in the toner container 71. The material and manufacturing method of the cap 72 are not limited.

The insertion guide 73 is fitted on the outside of the second container section 712, and is to be engaged with the cartridge holder 66. The insertion guide 73 mainly comprises a positioning member 731 and a discharge member 732. The positioning member 731 and discharge member 732 are integrally formed by a manufacturing method such as injection molding with high processing precision. Accordingly, the dimensional precision of each part of the insertion guide 73, like the cartridge holder 66, is very high. Thereby, the insertion guide 73 can be inserted in the cartridge holder 66 with little looseness. As a result, the toner cartridge 70 is coupled to a predetermined position of the cartridge holder 66 in a predetermined attitude.

The positioning member 731 is cylindrical, and has positioning groove portions 731*a* in its inner surface. The positioning groove portions 731*a* extend in the axial direction of the positioning member 731. When the second container section 712 is fitted in the positioning member 731, the positioning groove portions 731*a* receive the positioning projection portions 712*b* formed on the second container section 712. Thereby, the relative position and attitude of the second container section 712 and positioning member 731 are exactly and uniquely determined. In the meantime, the relative position and attitude of the second container section 712 and positioning member 731 may be determined by engagement between the outer surface of the peripheral wall of the second container section 712 and the inner surface of the positioning member 731.

Guide projection portions 731*b* are formed on the outer surface of the positioning member 731. The guide projection portions 731*b* extend in the axial direction of the positioning member 731. When the toner cartridge 70 is inserted in the copying machine main body 10, the guide projection portions 731*b* are engaged in the groove portions 66*f* formed in the inner surface of the cartridge holder 66. Thereby, the toner cartridge 70 is coupled to a predetermined position of the cartridge holder 66 in a predetermined attitude.

The discharge member 732 is disposed on the outer surface of the positioning member 731. The discharge member 732 mainly comprises a discharge plate 7321 and an engaging stepped portion 7322. The discharge plate 7321 protrudes radially outward of the positioning member 731, and a passage hole 7321*a* for passing toner is formed at a predetermined position of the discharge plate 7321. The passage hole 7321*a* has substantially the same shape and dimensions as the discharge port 712*a* formed in the second container section 712. If the second container section 712 is fitted in the insertion guide 73, the discharge port 712*a* and passage hole 7321*a* are opposed to each other to allow communication between the inside and outside of the toner container 71. Thereby, a supply port 713 (see FIG. 7 and FIG. 8) for supplying toner to the developing device 114 is formed at one end of the toner cartridge 70.

The engaging stepped portion 7322 extends from the end of the discharge plate 7321 toward the cap 72. The thickness of the engaging stepped portion 7322 is greater than that of the discharge plate 7321, and a sloping surface, which smoothly connects the outer surface of the engaging stepped portion 7322 and the outer surface of the discharge plate 7321, is formed at a connection part between the engaging stepped portion 7322 and the discharge plate 7321.

The shutter 74 is attached to the outer surface of the insertion guide 73 such that the shutter 74 is slidable in the axial direction of the toner container 71. The shutter 74 mainly comprises the closing plate 741 and engaging rods 742. The closing plate 741 is a part for opening/closing the supply port 713, and a seal member 741*a* is provided between the closing plate 741 and the discharge plate 7321 of the insertion guide 73. The seal member 741*a* is attached to the shutter 74 and prevents leak of toner from a gap between the closing plate 741 and discharge plate 7321. The engaging rods 742 extend from the closing plate 741 towards the cap 72. Projections 742*a* are formed at those parts of the distal end portions of the engaging rods 742, which are opposed to the insertion guide 73.

(Operation of Electrophotographic Copying Machine)

Next, the operation of the electrophotographic copying machine is described.

When an image is to be formed, light is radiated from the light source 32 on an original which is placed on the original table 31. The light is reflected by the original and then received by the light receiving element 33. Thereby, an image on the original is scanned. Based on the scanned information, the laser unit 113 emits a laser beam onto the surface of the photoconductor drum 111. The surface of the photoconductor drum 111 is charged, in advance, with a negative polarity by the charger 112. The surface of the photoconductor drum 111 is exposed with the laser beam from the laser unit 113.

Thereby, on the region corresponding to the image part of the original, the surface potential of the photoconductor drum 111 approaches to 0 in accordance with the density of the image, and an electrostatic latent image is formed on the surface of the photoconductor drum 111. The electrostatic latent image is brought to the position of the developing device 114 by the rotation of the photoconductor drum 111, and attracts toner at this position. Thus, the electrostatic latent image is developed into a toner image.

At this time, the paper sheet which is picked up from the sheet feed cassette 50 is conveyed along the convey system 20 and is fed into between the transfer device 115 and photoconductor drum 111. Thereby, the toner image formed on the surface of the photoconductor drum 111 is transferred to the paper sheet that is charged with a positive polarity.

The paper sheet, to which the toner image is transferred, is heated and pressed by the fixing device 116, and the toner image is fixed on the paper sheet. The paper sheet with the fixed toner image is discharged to the output tray 26 by the output roller 25.

The toner, which is not transferred to the paper sheet and remains on the photoconductor drum 111, is removed by the cleaning device 117 and recovered into the developing device 114. The toner recovered into the developing device 114 will be reused. Each time the toner in the developing device 114 is consumed by the development, toner is replenished from the toner cartridge 70.

(Assembly Process of Toner Cartridge 70)

Next, the assembly process of the toner cartridge 70 is described.

To begin with, the toner container 71, cap 72, insertion guide 73 that is formed by injection molding with high dimensional precision, and shutter 74 are prepared.

The second container section 712 of the toner container 71 is inserted in the positioning member 731 of the insertion guide 73. At this time, the positioning projection portions 712*b* formed on the second container section 712 are engaged in the positioning groove portions 731*a* formed in the positioning member 731.

Thereby, the relative position and attitude of the insertion guide 73 and toner container 71 are exactly and surely determined according to the design. As a result, the position of the discharge port 712*a* formed in the toner container 71 is made to completely agree with the position of the passage hole 7321*a* formed in the insertion guide 73, and the supply port 713 is formed.

When the second container section 712 of the toner container 71 is inserted in the positioning member 731 of the insertion guide 73, the gap between the positioning member 731 and the second container section 712 is sealed by the sealing projection portions 712*c* formed on the second container section 712.

Next, the shutter 74 is attached to the discharge plate 7321 of the insertion guide 73, and the closing plate 741 of the shutter 74 is set to close the supply port 713 of the toner cartridge 70. Thereby, one end portion of the toner container 71 is completely closed.

Subsequently, toner is filled in the toner container 71 from the filling port 711*b* formed at the other end portion of the toner container 71. Then, the cap 72 is attached to the filling port 711*b*. Thus, the manufacturing process of the toner cartridge 70 is completed.

(Attachment/Detachment Operation of Toner Cartridge 70)

Next, the attachment/detachment operation of the toner cartridge 70 is described.

Figure 7:
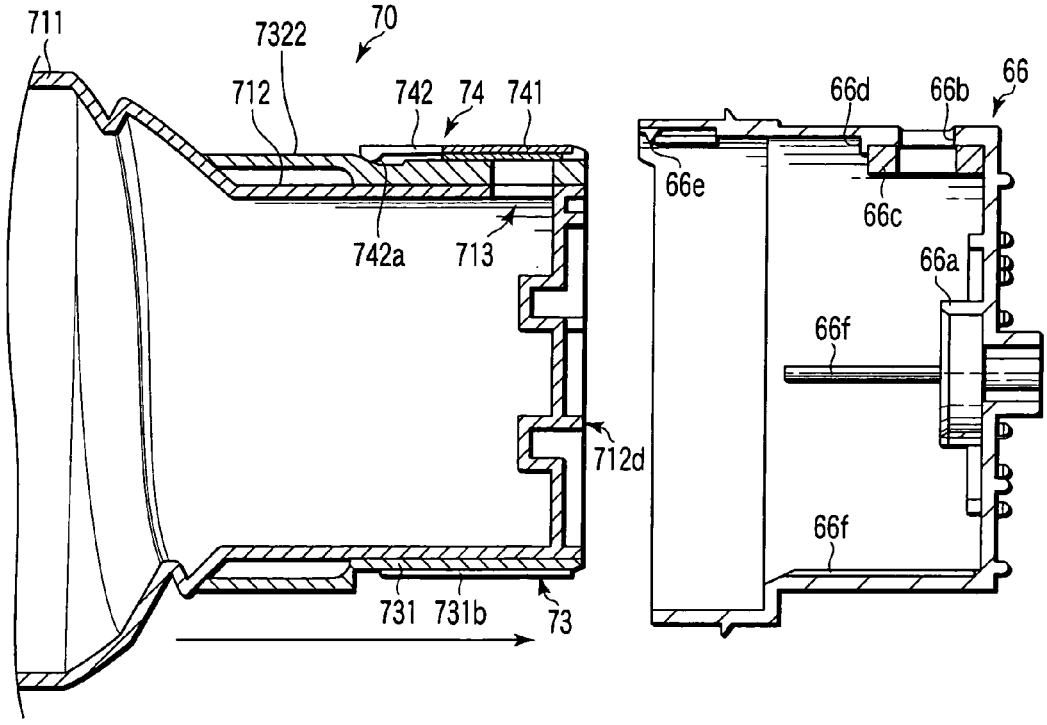
FIG. 7 schematically illustrates a state immediately before the toner cartridge in the embodiment is inserted in the cartridge holder.
Figure 8:
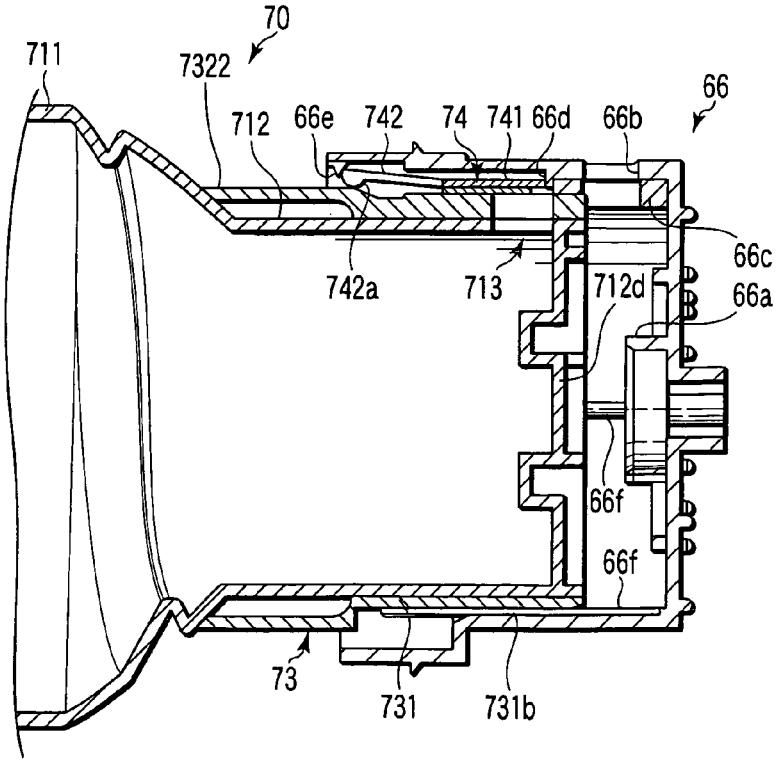
FIG. 8 schematically illustrates a state in which the toner cartridge in the embodiment is being inserted in the cartridge holder.

FIG. 7 schematically illustrates a state immediately before the toner cartridge 70 in the embodiment is inserted in the cartridge holder 66, and FIG. 8 schematically illustrates a state in which the toner cartridge 70 in the embodiment is being inserted in the cartridge holder 66.

As is shown in FIG. 7, the toner cartridge 70 is inserted, from its insertion guide 73, into the cartridge holder 66. At this time, as shown in FIG. 8, the guide projection portions 731*b* formed on the positioning member 731 of the insertion guide 73 are received in the guide groove portions 66*f* formed in the cartridge holder 66. Thus, the toner cartridge 70 is inserted in the cartridge holder 66 with an exact angle and attitude being kept.

If the closing plate 741 of the shutter 74 of the toner cartridge 70 reaches the first engaging portion 66*d* formed on the cartridge holder 66, the closing plate 741 is hooked on the first engaging portion 66*d* and stopped at this position. Thereby, only the shutter 74 is slid toward the cap 72, relative to the toner cartridge 70 that moves in the direction of the arrow, and the supply port 713 formed in the toner cartridge 70 is gradually opened.

If the toner cartridge 70 is further inserted, as shown in FIG. 8, the projections 742*a* formed on the engaging rods 742 of the shutter 74 move over the engaging stepped portion 7322 of the toner cartridge 70 that advances in the direction of the arrow and the engaging rods 742 are bent at their intermediate parts.

If the second container section 712 of the toner cartridge 70 abuts on the inner surface of the bottom wall of the cartridge holder 66, the insertion of the toner cartridge 70 is stopped at that time. In this case, if the recess-and-projection portion 712*d* formed on the end face of the second container section 712 corresponds to the recess-and-projection portion 66*a* formed on the end face of the cartridge holder 66, the position of the supply port 713 agrees with the position of the communication port 66*b*.

In addition, if the recess-and-projection portion 712*d* formed on the end face of the second container section 712 corresponds to the recess-and-projection portion 66*a* formed on the end face of the cartridge holder 66, the toner cartridge 70 is completely inserted in the cartridge holder 66 and the shutter 74 is slid to a position where the shutter 74 is completely retreated from the supply port 713. Thereby, the inside of the toner container 71 communicates with the outside of the cartridge holder 66. Thus, the mounting of the toner cartridge 70 is completed.

Next, the detachment operation of the toner cartridge 70 is described.

To begin with, the toner cartridge 70 is pulled from the cartridge holder 66. If the end portions of the engaging rods 742 of the shutter 74 of the toner cartridge 70 reach the second engaging portion 66*e* formed on the cartridge holder 66, the engaging rods 742 are hooked on the second engaging portion 66*e* and stopped at this position. Thereby, only the shutter 74 is slid in a direction away from the cap 72, relative to the toner cartridge 70 that moves in a direction opposite to the direction of the arrow. Thus, the supply port 713 formed in the toner cartridge 70 is closed.

If the toner cartridge 70 is further pulled after the supply port 713 formed in the toner cartridge 70 is closed, the projections 742*a* formed on the engaging rods 742 of the shutter 74 slide down from the engaging stepped portion 7322 of the toner cartridge 70 and the engagement between the engaging rods 742 and the engaging stepped portion 7322 is released. Hence, when the toner cartridge 70 is drawn out of the cartridge holder 66, the supply port 713 of the toner cartridge 70 is completely and surely closed.

(Functions of the Present Embodiment)

The toner cartridge 70 according to the present embodiment includes the insertion guide 73, which is formed by injection molding with high dimensional precision, at the part that is to be engaged with the cartridge holder 66. Accordingly, while the toner cartridge 70 is inserted in the cartridge holder 66, the attitude of the insertion guide 73 is exactly maintained relative to the cartridge holder 66. Thus, no part of the toner cartridge 70 is unintentionally put in contact with the cartridge holder 66. Therefore, while the toner cartridge 70 is being inserted, the shutter 74 is not slid, nor is the seal member 66*c* removed.

The projection portions 712*c* for sealing are formed on the outer surface of the peripheral wall of the second container section 712 so as to extend in the circumferential direction of the second container section 712. In addition, these sealing projection portions 712*c* are arranged in the axial direction of the toner container 71 so as to sandwich the peripheral edge of the discharge port 712*a*. In the state in which the projection portions 712*c* for sealing are engaged with the positioning member 731 of the insertion guide 73, the projection portions 712*c* for sealing are put in close contact with the inner surface of the positioning member 731 under high pressure.

Therefore, toner, which is discharged from the discharge port 712*a* of the toner container 71, is exactly led to the passage hole 7321*a* formed in the insertion guide 73. Moreover, as described above, the insertion guide 73 is formed by injection molding with high dimensional precision. Thus, if the toner cartridge 70 is mounted in the copying machine main body 10, the passage hole 7321*a* formed in the insertion guide 73 is exactly opposed to the communication port 66*b* of the cartridge holder 66. Thereby, the toner, which is led to the passage hole 7321*a* of the insertion guide 73, is exactly brought to the communication port 66*b* of the cartridge holder 66. Therefore, the toner, which is discharged from the toner cartridge 70, does not unintentionally leak in the copying machine main body 10. In other words, the toner discharged from the toner cartridge 70 is exactly supplied to the developing device 114.

Furthermore, the toner cartridge 70 comprises the four pieces, that is, the toner container 71, cap 72, insertion guide 73 and shutter 74. Of these components, only the insertion guide 73 is formed by injection molding. Thus, the manufacturing cost of the toner cartridge 70 does not increase. The toner container 71, which is difficult to manufacture by injection molding, is formed by blow molding as in the prior art. Therefore, the manufacture of the toner cartridge 70 does not become difficult.

In the present embodiment, the cylindrical positioning member 731 is used as the "member" in the present invention. However, the "member" in the present invention is not limited if it is engageable with the cartridge holder 66.

In the embodiment, the toner cartridge 70, in which toner is conveyed by the rotation of the toner container 71, is used. However, the invention is not limited to this. For example, it is possible to use a toner cartridge 70 in which the toner container is not rotated and the toner is conveyed by the rotation of an auger which is disposed within the toner container.

In the present embodiment, the seal member 66*c* is fixed to the inner surface of the cartridge holder 66. The invention, however, is not limited to this. For example, the seal member 66*c* may be fixed to the outer surface of the shutter 74.

The present invention is not limited to the above-described embodiment. In practice, the structural elements can be modified without departing from the spirit of the invention. Various inventions can be made by properly combining the structural elements disclosed in the embodiment. For example, some structural elements may be omitted from all the structural elements disclosed in the embodiment. Furthermore, structural elements in different embodiments may properly be combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A toner cartridge, comprising:

a toner container which contains toner, the toner container having at one end portion thereof a discharge port which discharges the toner; and a member which is attached to an outer peripheral surface of said one end portion, the member having:

a first part which is engaged with said one end portion;

a second part which has, at a position corresponding to the discharge port, a passage hole through which the toner discharged from the discharge port passes; and a projection portion which is formed on an outer surface of the member and extends in an axial direction of the toner container.

2. A toner cartridge comprising:

a toner container which contains toner, the toner container having at one end portion thereof a discharge port which discharges the toner; and a member which is attached to an outer peripheral surface of said one end portion, the member having:

a first part which is engaged with said one end portion;

a second part which has, at a position corresponding to the discharge port, a passage hole throuah which the toner discharged from the discharge port passes; and a groove portion which is formed on an inner surface of the member and extends in an axial direction of the toner container.

3. A toner cartridge comprising:

a toner container which contains toner, the toner container having at one end portion thereof a discharge port which discharges the toner; and a member which is attached to an outer peripheral surface of said one end portion, the member having:

a first part which is engaged with said one end portion; and a second part which has, at a position corresponding to the discharge port, a passage hole through which the toner discharged from the discharge port passes, wherein the one end portion has a plurality of projection portions which are formed on an outer surface of the one end portion and extend in a circumferential direction of the toner container, at least one of the projection portions being disposed on both sides of the discharge port and the passage hole in an axial direction of the toner container.

4. An image forming apparatus, comprising:

an apparatus main body in which a space is defined;

an image carrying unit which is disposed within the apparatus main body;

an image forming unit which is disposed within the apparatus main body and forms an electrostatic latent image on the image carrying unit;

a developing unit which is disposed within the apparatus main body and supplies toner to the electrostatic latent image, thereby forming a toner image, which corresponds to the electrostatic latent image, on the image carrying unit;

a transfer unit which is disposed within the apparatus main body and transfers the toner image, which is formed on the image carrying unit, to a transfer medium; and a toner cartridge which is detachably mounted in the apparatus main body and supplies toner to the developing unit, the toner cartridge including:

a toner container which contains toner, the toner container having at one end portion thereof a discharge port which discharges the toner that is contained in the toner container; and a member which is attached to said one end portion of the toner container, the member having:

a first part which is engaged with said one end portion and is engaged, when the toner cartridge is mounted in the apparatus main body, with a part of the apparatus main body, thereby determining a position and an attitude of the member;

a second part which has, at a position corresponding to the discharge port, a passage hole through which the toner discharged from the discharge port passes; and a projection portion which is formed on an outer surface of the member and extends in an axial direction of the toner container, the projection portion being guided by a part of the apparatus main body at a time of mounting in the apparatus main body.

5. An image forming apparatus, comprising:

an apparatus main body in which a space is defined;

an image carrying unit which is disposed within the apparatus main body;

an image forming unit which is disposed within the apparatus main body and forms an electrostatic latent image on the image carrying unit;

a developing unit which is disposed within the apparatus main body and supplies toner to the electrostatic latent image, thereby forming a toner image, which corresponds to the electrostatic latent image, on the image carrying unit;

a transfer unit which is disposed within the apparatus main body and transfers the toner image, which is formed on the image carrying unit, to a transfer medium; and a toner cartridge which is detachably mounted in the apparatus main body and supplies toner to the developing unit, the toner cartridge including:

a toner container which contains toner, the toner container having at one end portion thereof a discharge port which discharges the toner that is contained in the toner container; and a member which is attached to said one end portion of the toner container, the member having:

a first part which is engaged with said one end portion and is engaged, when the toner cartridge is mounted in the apparatus main body, with a part of the apparatus main body, thereby determining a position and an attitude of the member;

a second part which has, at a position corresponding to the discharge port, a passage hole through which the toner discharged from the discharge port passes; and a groove portion which is formed on an inner surface of the member and extends in an axial direction of the toner container, the groove portion being guided by a part of the apparatus main body at a time of mounting in the apparatus main body.

6. An image forming apparatus, comprising:

an apparatus main body in which a space is defined;

an image carrying unit which is disposed within the apparatus main body;

an image forming unit which is disposed within the apparatus main body and forms an electrostatic latent image on the image carrying unit;

a developing unit which is disposed within the apparatus main body and supplies toner to the electrostatic latent image, thereby forming a toner image, which corresponds to the electrostatic latent image. on the image carrying unit;

a transfer unit which is disposed within the apparatus main body and transfers the toner image, which is formed on the image carrying unit, to a transfer medium; and a toner cartridge which is detachably mounted in the apparatus main body and supplies toner to the developing unit, the toner cartridge including:

a toner container which contains toner, the toner container having at one end portion thereof a discharge port which discharges the toner that is contained in the toner container; and a member which is attached to said one end portion of the toner container, the member having:

a first part which is engaged with said one end portion and is engaged, when the toner cartridge is mounted in the apparatus main body, with a part of the apparatus main body, thereby determining a position and an attitude of the member; and a second part which has, at a position corresponding to the discharge port, a passage hole through which the toner discharged from the discharge port passes, wherein the one end portion has a plurality of projection portions which are formed on an outer surface of the member one end portion and extend in a circumferential direction of the toner container, at least one of the projection portions being disposed on both sides of the discharge port and the passage hole in an axial direction of the toner container.

* * * * *